US008701571B2

(12) United States Patent
Grant

(10) Patent No.: US 8,701,571 B2
(45) Date of Patent: Apr. 22, 2014

(54) TRANSPORT PALLET

(75) Inventor: Albert Donald Grant, New South Wales (AU)

(73) Assignee: Prime Pallets Pty Ltd, Sydney, New South Wales (AU)

( * ) Notice: Subject to any disclaimer, the term of this patent is extended or adjusted under 35 U.S.C. 154(b) by 0 days.

(21) Appl. No.: 13/391,252

(22) PCT Filed: Aug. 20, 2010

(86) PCT No.: PCT/AU2010/001069
§ 371 (c)(1),
(2), (4) Date: Mar. 28, 2012

(87) PCT Pub. No.: WO2011/020154
PCT Pub. Date: Feb. 24, 2011

(65) Prior Publication Data

US 2012/0174834 A1 Jul. 12, 2012

(30) Foreign Application Priority Data

Aug. 20, 2009 (AU) ..... 2009904002

(51) Int. Cl.
*B65D 19/38* (2006.01)

(52) U.S. Cl.
USPC ..... 108/57.25

(58) Field of Classification Search
USPC ..... 108/57.25, 51.11, 901, 902, 56.1, 56.3; 248/346.02; 206/386, 600
See application file for complete search history.

(56) References Cited

U.S. PATENT DOCUMENTS

| | | | | |
|---|---|---|---|---|
| 5,736,221 | A * | 4/1998 | Hardigg et al. | 428/116 |
| 5,967,057 | A * | 10/1999 | Nakayama et al. | 108/57.25 |
| 6,138,582 | A * | 10/2000 | Fujii et al. | 108/57.25 |
| 6,357,366 | B1 | 3/2002 | Frankenberg | |
| 6,718,888 | B2 | 4/2004 | Muirhead | |
| 6,938,558 | B1 * | 9/2005 | Peres | 108/57.25 |
| 8,215,244 | B2 * | 7/2012 | Apps | 108/57.25 |
| 2003/0061974 | A1 * | 4/2003 | Smyers | 108/57.25 |
| 2006/0075939 | A1 * | 4/2006 | Shuert | 108/57.25 |
| 2008/0141912 | A1 * | 6/2008 | Valentinsson | 108/57.25 |
| 2009/0000527 | A1 * | 1/2009 | Ficker | 108/57.25 |
| 2009/0183655 | A1 * | 7/2009 | Ogburn | 108/57.25 |
| 2010/0154685 | A1 * | 6/2010 | Arinstein | 108/57.25 |
| 2011/0073018 | A1 * | 3/2011 | Apps | 108/57.25 |

OTHER PUBLICATIONS

International Search Report issued on Nov. 9, 2010 in related International Patent Application No. PCT/AU2010/001069 (5 pages).

* cited by examiner

*Primary Examiner* — Jose V Chen
(74) *Attorney, Agent, or Firm* — Brinks Gilson & Lione

(57) ABSTRACT

A rectangular pallet that is symmetrical about its two major axes. The pallet comprises a first plastics shell and a second plastics shell. The first plastics shell is formed with a flat rim, nine or more ground engaging feet subtending below the level of the rim, the feet being arranged in respective parallel spaced apart beams extending from front to back. The first plastics shell also has plural channels running from side to side intersecting the beams running from front to back to define the feet. The second plastics shell is essentially flat and formed with a flat rim. An internal network of partitions extends between the first and second plastics shells. The rims of the first and second plastics shells are sealed to each other to form a clam and to enclose the network of partitions within the clam. In other aspects, the invention concerns a method and a system for forming the pallet.

23 Claims, 7 Drawing Sheets

TRANSPORT PALLET

RELATED APPLICATIONS INFORMATION

This present application claims the benefit of priority as a national stage of International Application No. PCT/AU2010/001069 filed on Aug. 20, 2010, which in turn claims priority from Australian Provisional Application No 2009904002 filed on Aug. 20, 2009, the contents of which are incorporated herein by reference.

TECHNICAL FIELD

This invention concerns pallets of the kind used to transport and store goods. In particular the invention concerns a pallet made from plastics material. In other aspects, the invention concerns a method and a system for forming the pallet.

BACKGROUND ART

Pallets have been used for a long time now to store and transport many different kinds of goods. The advantage of using a pallet is that it provides a standard platform for goods that can be handled in the same manner regardless of the nature of the goods. Pallets generally are shaped to enable lifting by means of a fork lift, and to enable racking. Lifting by means of a fork lift requires space underneath the platform for the tines to be inserted from the front or rear. Racking generally requires the pallet to rest on two rails that engage under the edges of opposed sides of the pallet. A simple timber pallet design has become ubiquitous around the world, and other designs have had greater difficulty in achieving wide acceptance.

DISCLOSURE OF THE INVENTION

In a first aspect, the invention is a rectangular pallet, symmetrical about its two major axes, and comprising:

a first plastics shell formed with a flat rim, nine or more ground engaging feet subtending below the level of the rim, the feet being arranged in respective parallel spaced apart beams extending from front to back, and the first plastics shell also having plural channels running from side to side intersecting the beams running from front to back to define the feet; and a second essentially flat plastics shell formed with a flat rim;

wherein an internal network of partitions extending between the first and second plastics shells;

and wherein the rims of the first and second plastics shells are sealed to each other to form a clam and to enclose the network of partitions within the clam.

Using the invention, the plural beams extending from front to back and channels extending from side to side to define the feet provide structural strength to resist high tensile stresses during use. The rims of the first and second plastics shells are sealed along their periphery to further strengthen the pallet. Structural rigidity is further provided by the internal network of partitions between the first and second plastics shells.

Advantageously, the pallet does not require a metal rod or steel beam for reinforcement, which adds significant cost and weight and complicates recycling of the pallet. Also, unlike timber pallets, the present plastics pallet is washable, resistance to insect attacks and microscopic growth. Further, since the pallet is symmetrical around its two major axes, a load may be oriented along any axis without affecting the pallet's performance.

The internal network of partitions may extend along and across the beams in a grid-like structure between the first and second plastics shells. The partitions may be integral with the first plastics shell such that tops of the internal network of partitions contact bottoms of the second plastics shell when the rims are sealed to each other.

The beams may be spaced apart from each other to allow the tines of a forklift to be inserted into channels running between them from front to back. Also the feet of each beam may be spaced apart from each other so that racking may engage into channels running between them from front to back. The channels extending from front to back may be deeper than the channels running from side to side. The tines of a forklift may also be inserted into the channels running between the feet.

The first plastics shell may also comprise an array of inverted wells in its underside. The array of inverted wells may be formed in the surface of the first plastics shell. The (bottom of the) wells may extend up into the second plastics shell between the internal network of partitions. The (bottom) upper part of the wells may extend up to contact the underside of the second shell. To two shells may be joined at the points of contact.

Plural shallow recesses may be formed in the upper surface of the second plastics shell to receive the feet of another pallet that is stacked on it. The upper part of the wells may extend up to contact the underside of the shallow recesses in the second shell. The two shells may be joined at the points of contact between the upper part of the wells and the underside of the second plastics shell.

A radio frequency identification (RFID) transducer may be sealed within the pallet. The first plastics shell may comprise an integral pocket shaped and sized to receive and retain the RFID transducer.

A sign may be moulded into the first or second plastics shell, or both.

The first plastics shell may be formed with twelve ground engaging feet, the feet being arranged in three beams of four feet each.

The shells of the clam may be made of plastics material that is washable and food grade compatible. The plastics material is impregnated with sterilizer to provide resistance against bacteria. The plastics material is high density polyethylene (HDPE).

The first and second plastics shells may be moulded using one or more moulding machines. The first and second plastics shells may be different colours.

The rims of the first and second plastics shell are sealed together using a welding machine. The points of contact may also be joined using the welding machine.

In a second aspect the invention is a method of forming a pallet, comprising the steps of:

(a) moulding the first and second plastics shells;

(b) sealing the flat rim of the first plastics shell to the flat rim of the second plastics shell to form a clam.

The first and second shells may be moulded using injection moulding, vacuum moulding or rotational moulding. The method may comprise the further step of placing a radio transducer within a pocket in the first plastics shell between step (a) and step (b). After sealing the rims may be milled. The rims may be sealed using a vibration welding method. Any other points of contact between the shells may also be joined using the vibration welding method.

In a third aspect, the invention is a system for forming the pallet according to first aspect, comprising:

a moulding machine to mould the first and second plastics shell; and a welding machine to seal the rim of the first plastics shell to the rim of the second plastics shell to form a clam.

BRIEF DESCRIPTION OF DRAWINGS

An example of the invention will now be described with reference to the accompanying drawings, in which:

FIG. 4(*b*) is a side cross-sectional view of the pallet taken substantially along A-A of FIG. 4(*a*).

DETAILED DESCRIPTION OF THE INVENTION

Figure 1:
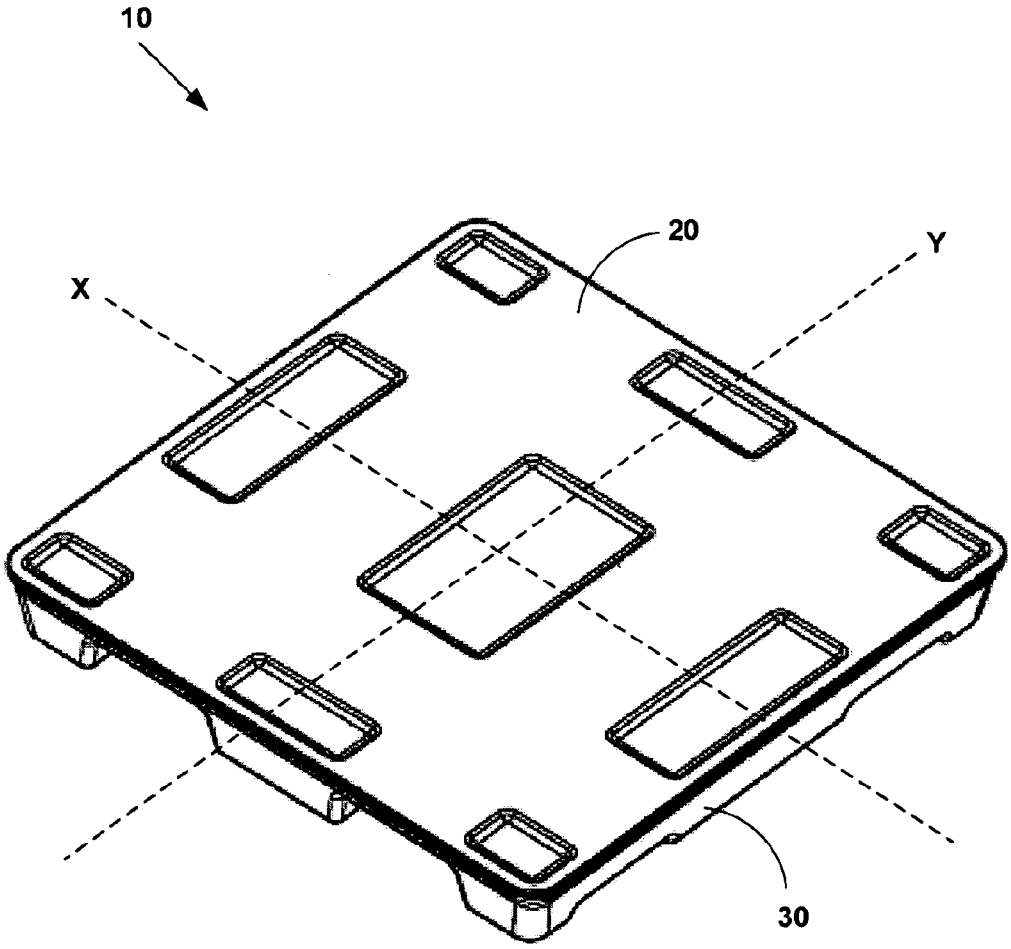
FIG. 1 is a top perspective view of a pallet exemplifying the invention.

Referring first to the top perspective view in FIG. 1, the transport pallet 10 exemplifying the invention is generally rectangular with four rounded comers. The pallet 10 has a four-way symmetry about its two central major axes, indicated as X and Y. Loads placed on the pallet 10 will generally be orientated along one of the axes.

Figure 2:
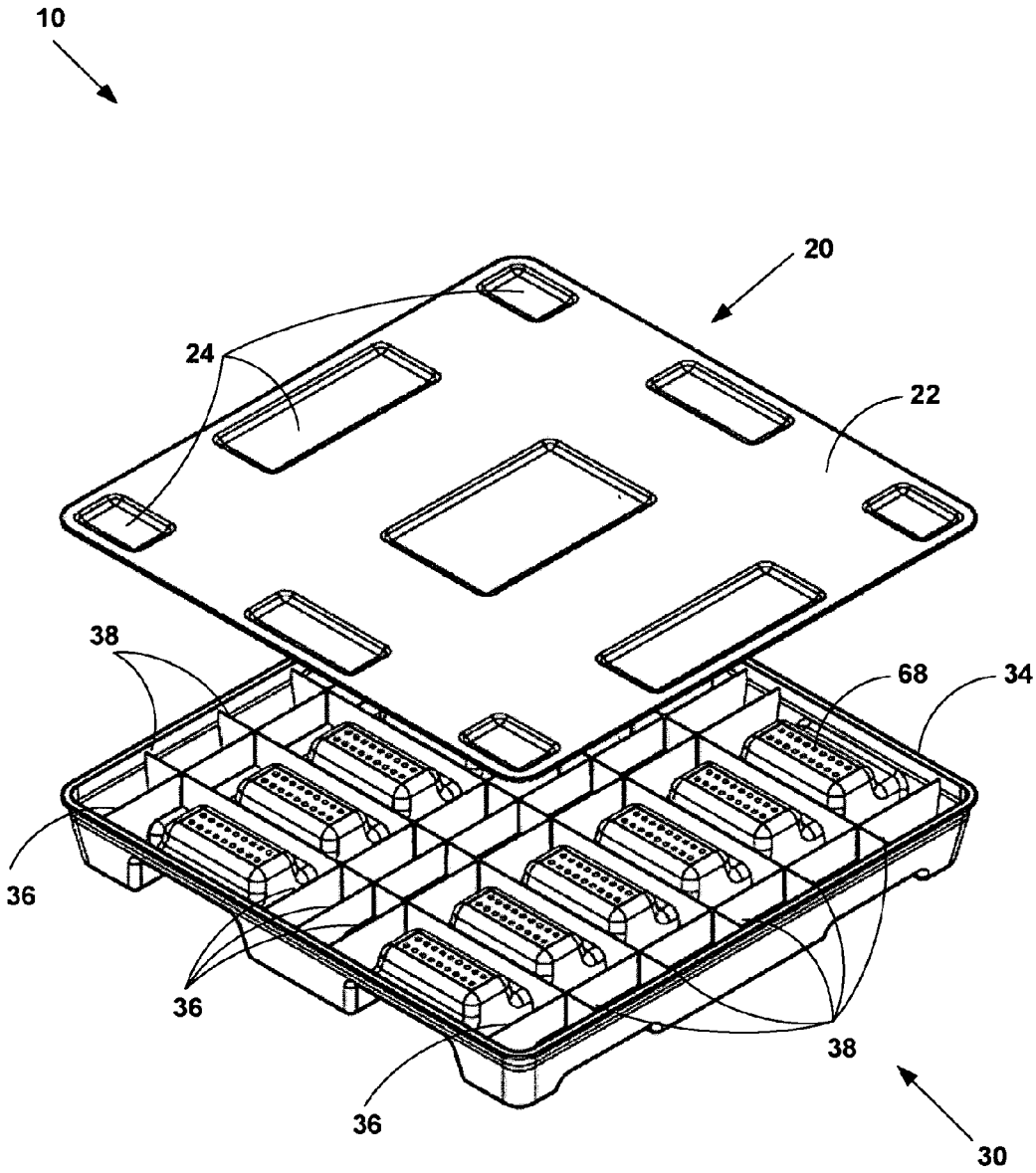
FIG. 2 is an exploded perspective view of the pallet in FIG. 1.

Referring also to the exploded view in FIG. 2, the pallet 10 comprises two moulded parts: a first plastics shell 30 that functions as a base and a second plastics shell 20 that functions as a lid for the first plastics shell 30.

The second plastics shell 20 comprises an essentially flat load supporting surface 22 and a flat rim formed under its periphery 24. The load supporting surface 22 has fine texture formed in it (not shown) to reduce product slip. A corresponding flat rim 34 is formed on top of the outer edge of the first plastics shell 30, allowing both rims 24 and 34 to contact each other closely when the shells are brought together and sealed to form a clam.

As shown more clearly in the (inverted) bottom perspective view in FIG. 3, the first plastics shell 30 further comprises plural integrally formed ground engaging feet 40, 42 and 44 subtending below the level of the rim 34.

The ground engaging feet 40, 42 and 44 (only one set is labelled for simplicity) are arranged in beams or rows of feet 46,48 and 50 that run from front to back of the pallet 10. In the embodiment shown, two middle elongated feet 42 arranged between two outer feet 40 and 44 in each beam 46, 48 and 50. The feet 40, 42 and 44 are interconnected by each respective beam 46, 48 and 50 to improve their structural strength.

Figure 3:
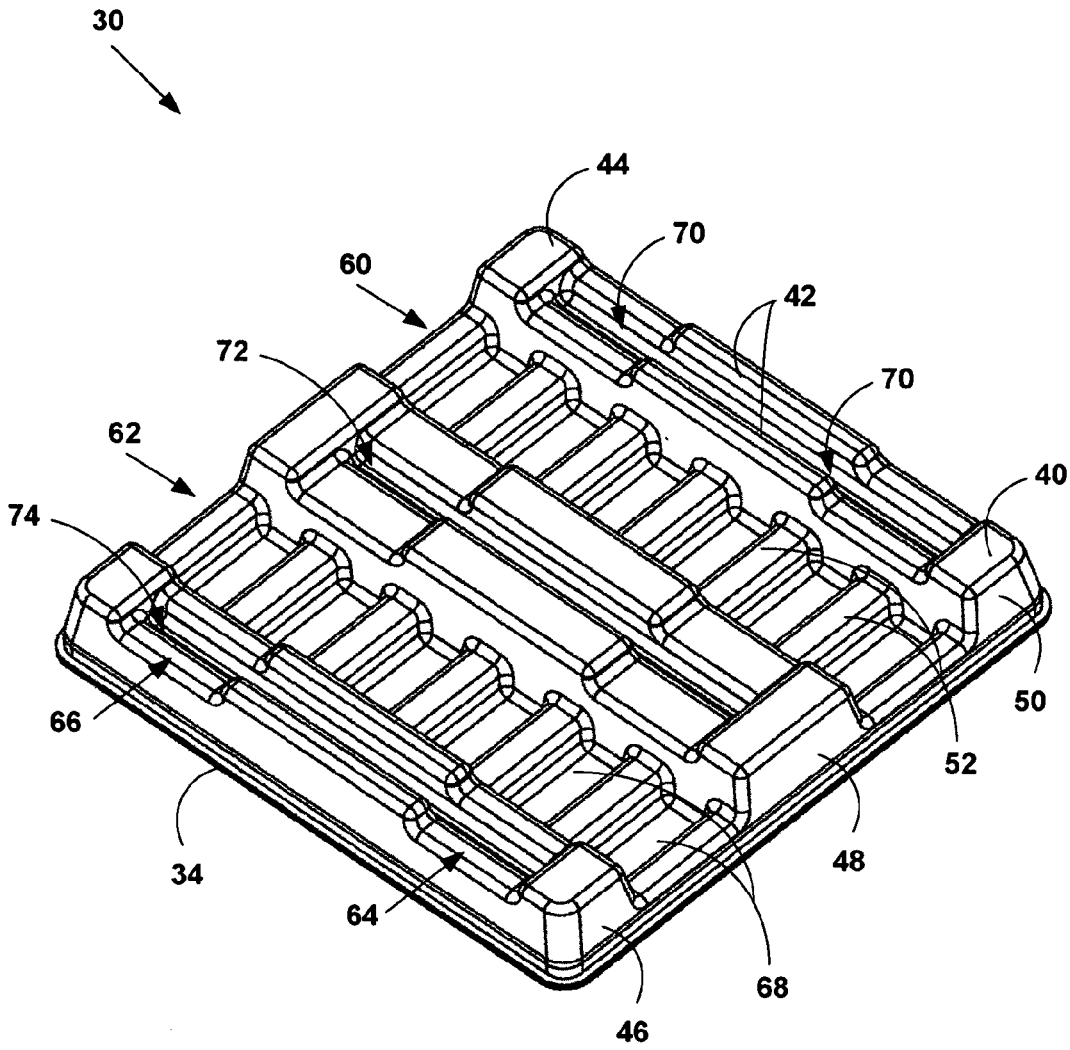
FIG. 3 is a bottom perspective view (inverted) a first plastics shell of the pallet.

The pallet 10 is designed to allow entry of tines of a lifting device such as a forklift from all four sides; see FIG. 3. A first pair of parallel channels 60 and 62 extends from front to back between the beams to receive the tines of a lifting device from a direction that is parallel to the beams 46, 48 and 50. Channel 60 is formed between beams 48 and 50 while channel 62 is formed between beams 48 and 46.

A second pair of parallel channels 64 and 66 run from side to side across the beams to provide locations for the pallet to be stacked on racks and to receive tines of a forklift from the sides. The second pair of channels 64 and 66 also define the feet 40, 42 and 44.

The second pair of channels 64 and 66 is shallower than the first pair of channels 60 and 62, however, in this example they also allow lifting from the sides. The shallower channels 64, 66 are shaped and sized such that tines of a forklift stay flush with the channels 64, 66 on the underside of the first plastics shell 30 during use. This helps to strengthen the engagement between the channels 64, 66 and the tines.

There are additional channels 70, 72 and 74 running between the feet 42, and these further strengthen the structure and especially the respective beams 50, 48 and 46.

The first plastics shell 30 further comprises plural integrally formed reinforcing channels 52 subtending below the rim 34. The reinforcing channels 52 extend between the beams 46, 48 and 50 to further enhance the structural strength of the first plastics shell 30.

Between the reinforcing channels 52 and the beams 46, 48 and 50 there are wells 68 in the underside of the first shell 30 extending upwards towards the rim 34; see also FIG. 2.

Figure 4:
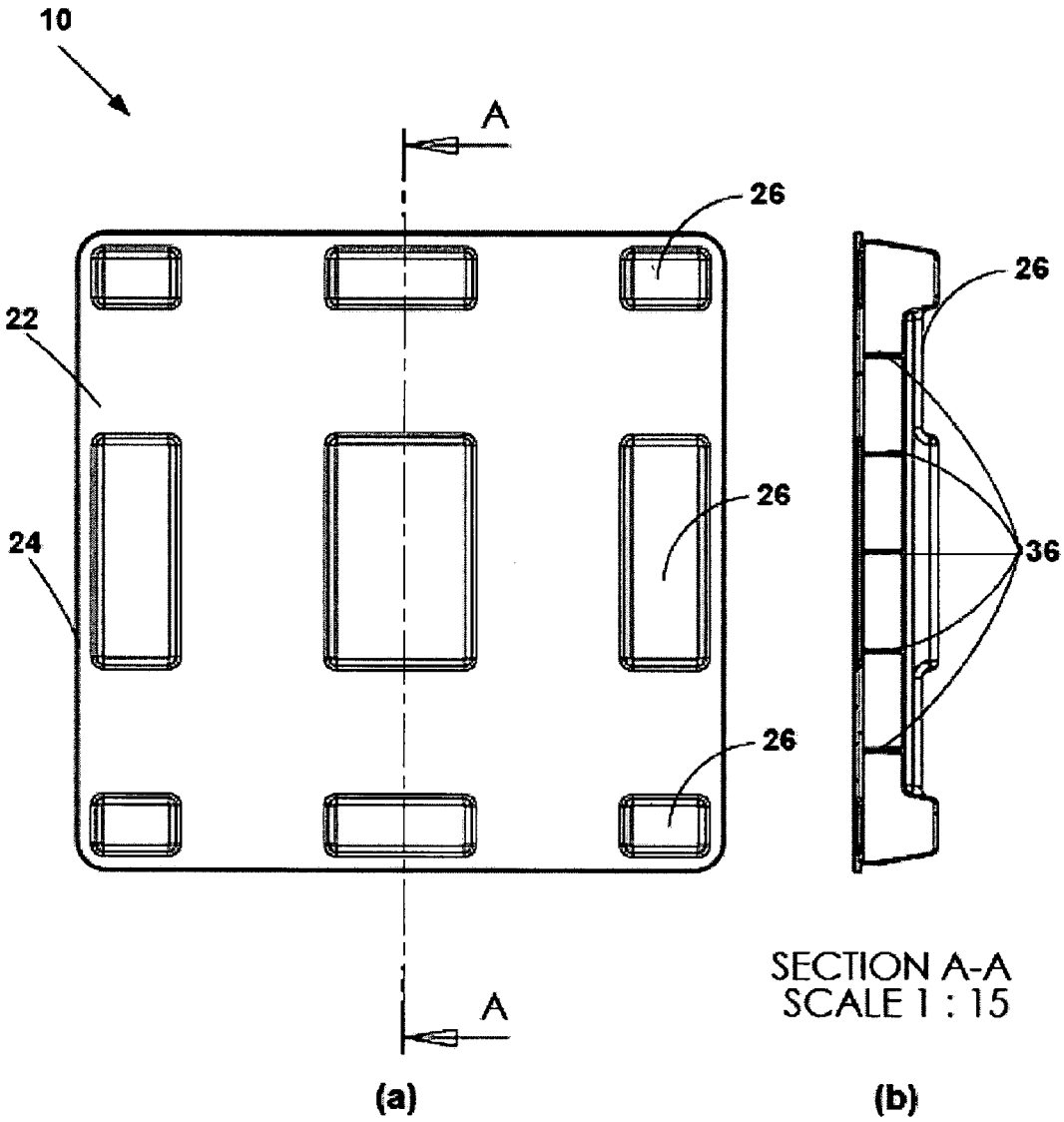
FIG. 4(*a*) is a top view of the pallet.

Referring to the perspective view in FIG. 2 again and also to the cross-sectional view in FIG. 4(*b*), a network of partitions 36, 38 are also integrated within the first plastics shell 30. The network of partitions 36, 38 form a grid-like structure that further provides structural rigidity to the integral beams 46, 48 and 50.

As shown, the network of partitions comprises a first set of partitions 36 that extend within the first plastics shell 30 along the length 'of the beams 46, 48 and 50. The network also further comprises a second set of partitions 38 that extends across the beams 46, 48 and 50 between the wells 68. The network of partitions 36, 38 also extend upwardly from the feet 46, 48 and 50 towards the rim 34 of the first plastics shell 30, that is between the first 30 and second 20 plastics shells to support the surface of the upper shell 20.

When the rims 24 and 34 of the shells 20 and 30 are brought together to form a clam, the clam encloses the network of partitions 36 and the wells 68. The tops of the partitions 36 and the bottoms of the wells 68 contact the underside of the upper shell 20. The bottoms of the wells 68 are joined to the underside of the upper shell 20. The rims 24 and 34 of the shells 20 and 30 are also joined, in a fashion that ensure a seal all around the edges of the clam.

As shown in FIGS. 1, 2 and 3, the first pair of channels running front to back 60, 62 and the second pair of channels running from side to side 64, 66 all have rounded or bevelled edges, thereby reducing potential damages to the pallet 10 during use. Edges of the wells 68 and reinforcing channels 52 are also rounded or bevelled for strength and to reduce damage during use.

Figure 5:
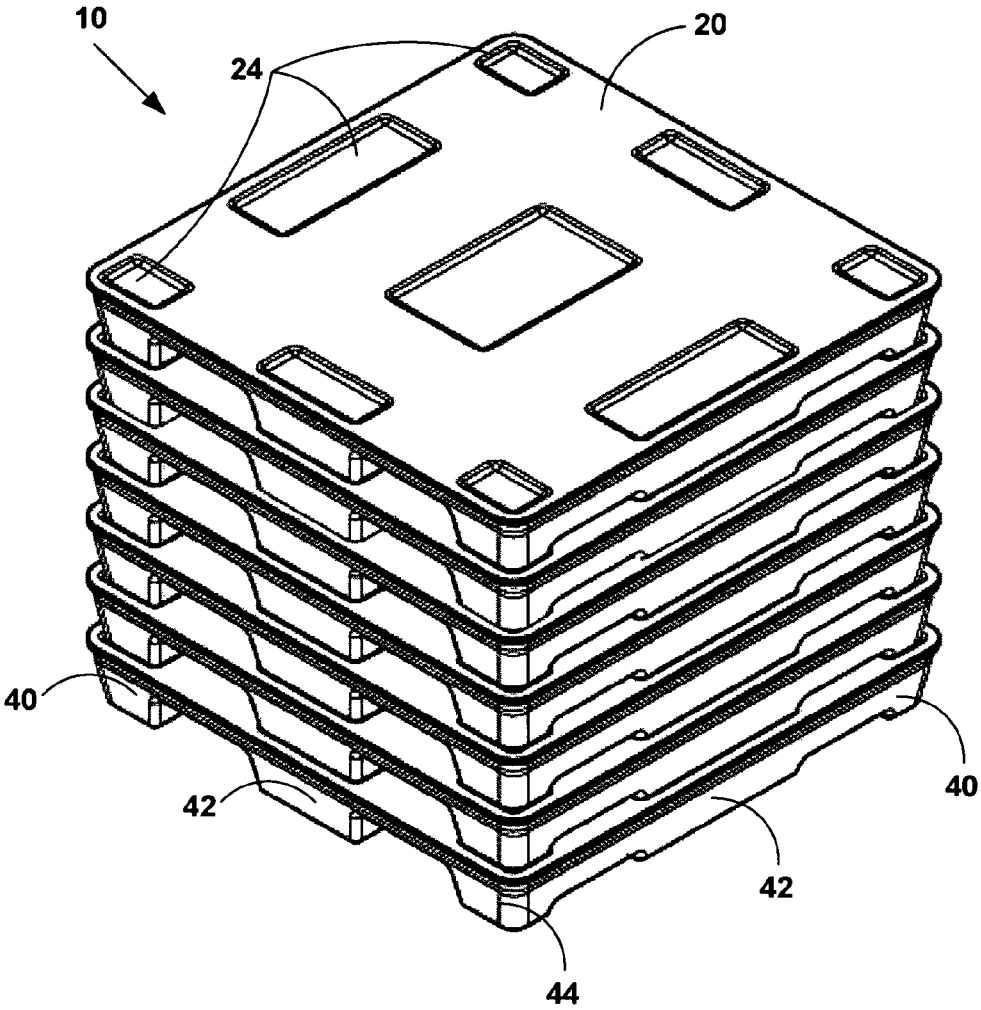
FIG. 5 is a perspective view of a stack of pallets.

Referring now FIGS. 4(*a*) and (*b*), plural recesses 26 are formed in the upper surface of the second plastics shell 20 to provide further strength and rigidity, and to assist with stacking; see FIG. 5. The recesses 26 are 10 mm deep to receive corresponding ground engaging feet 40, 42 and 44 of another pallet. The recesses 26 also permit a degree of nesting that reduces the overall stack height.

Figure 6:
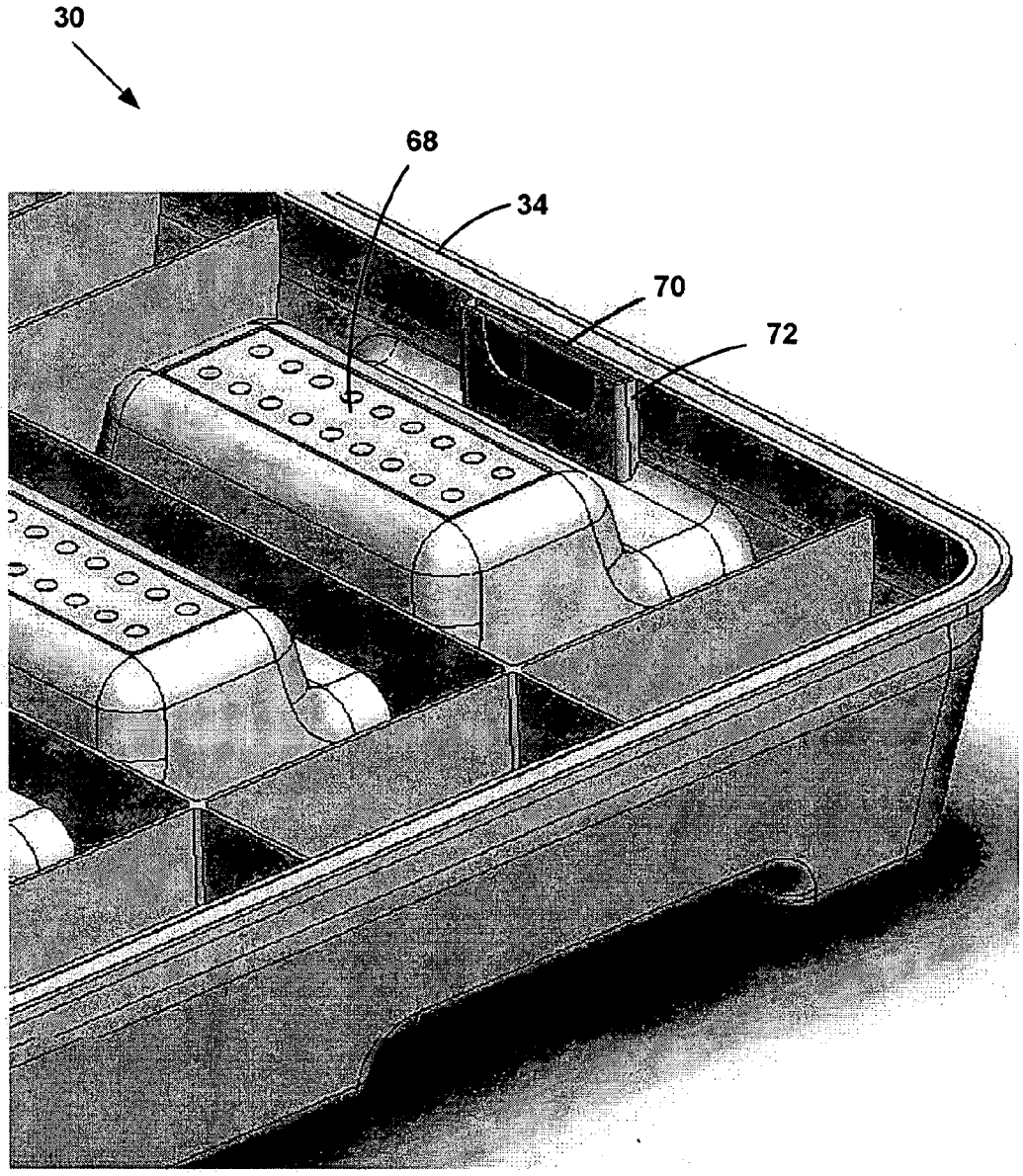
FIG. 6 is a top perspective view of one section of the first plastics shell in FIG. 3.

Another feature of the pallet 10 is shown in the top perspective view of one section of the first plastics shell 30 in FIG. 6. A radio frequency identification (RFID) transducer 80 is placed in a pocket 82 shaped and sized to receive and retain the transducer 80. The pocket 82 is integral with the first plastics shell 30 and located adjacent to one side of the rim 34. The transducer 80 is placed in the pocket 82 prior to sealing the first 30 and second 20 plastics shells together. This way, the RFID transducer 80 can be permanently located within the pallet 10 with minimum assembly.

The RFID transducer 80 includes an antenna for receiving and transmitting radio frequency signal and an integrated circuit for processing incoming and outgoing signals (not shown). In use, the RFID transducer 80 allows pallets 10, and their contents, to be individually identified and tracked. The transducer 80 can also record the date the pallet 10 is manufactured and how many times the pallet 10 has been used.

While not shown, the pallet 10 can have a moulded indelible sign on the first 30 or second 20 plastics shell, or both. A sign can be a logo, slogan or advertisement of the company to whom the pallet 10 belongs.

Material

The pallet 10 is made of high-grade plastics material having the following attributes:

(a) high rigidity to minimise deflection under load;

(b) high impact strength to withstand rough handling at varying temperature;

(c) good chemical resistance to withstand environmental and cleaning agents;

(d) food compatibility to enable use in food handling environments;

(e) weldability to enable sealing of the rims 24 and 34 to form a clam;

(f) abrasion resistance to resist abrasion and wear during usage; and (g) recyclability to facilitate recycling at the end of its useful lifetime.

One suitable material is high density polyethylene (HPDE), which is suitable for rough use in cool room environments and provides some strength against brittleness. HDPE is readily available in food grade suitable for use in contact with food. HDPE is also washable, having excellent chemical resistance against most cleaning agents to withstand multiple cleaning cycles. HDPE can also be impregnated with sterilizer to provide a sterile surface with resistance against bacteria. A blowing agent can be added to HDPE to reduce weight and increase stiffness.

HDPE can be supplied pre-coloured or coloured during the moulding process by addition of colourant. Advantageously, the first 30 and second 20 plastics shell can be made in different colours to allow visual identification.

Manufacturing Process

Figure 7:
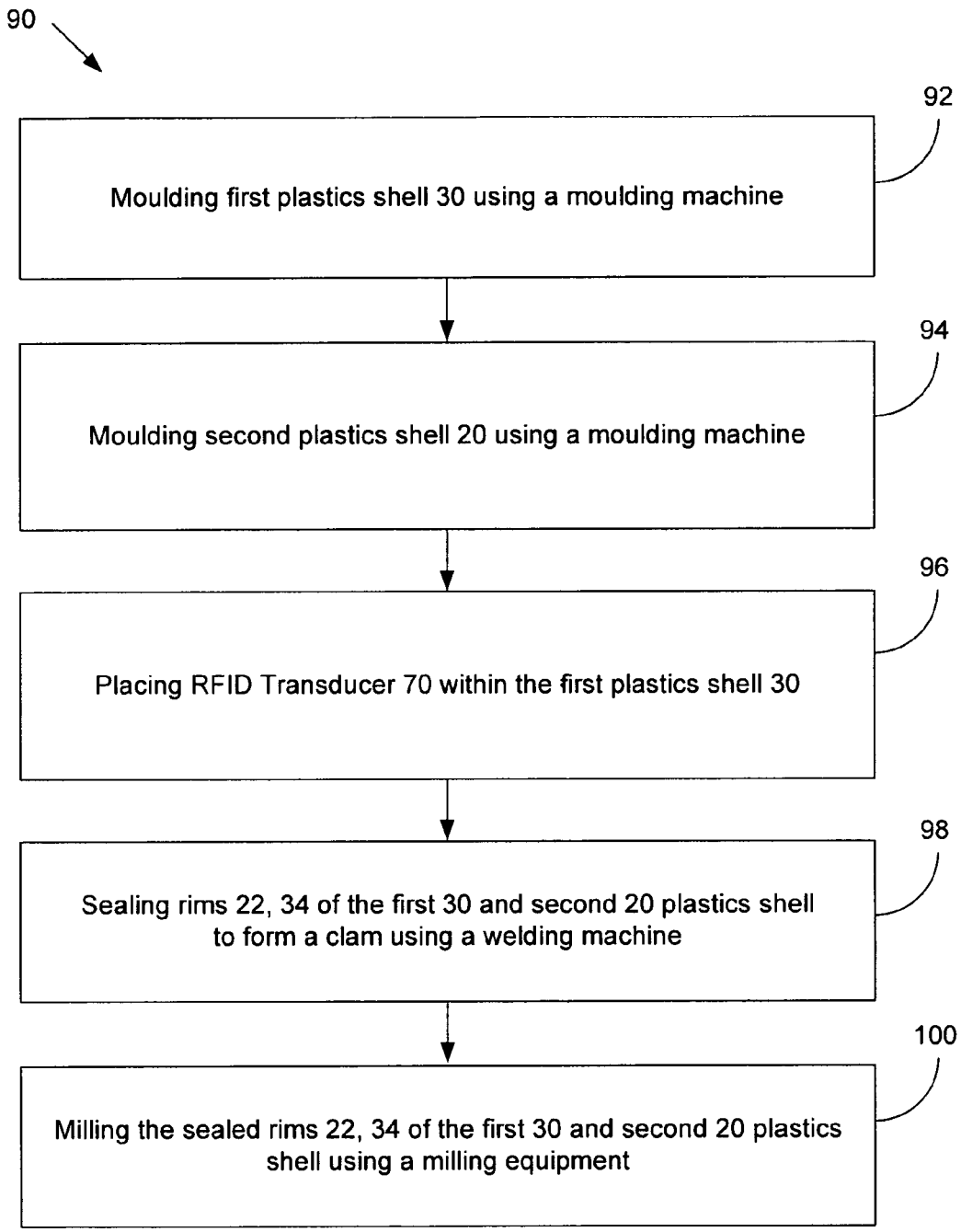
FIG. 7 is a flowchart of a method for forming the pallet.

Referring to the flowchart in FIG. 7, the pallet 10 is manufactured by first moulding the first 30 and second 20 plastics shells; see steps 92 and 94. Moulding techniques such as injection moulding, vacuum moulding and rotational moulding can be used.

To mould the first 30 and second 20 plastics shells using different colours, the shells can either be moulded using two separate moulding machines, or a single machine having a "stack" mould. The "stack" mould comprises two sections to each mould a shell 20, 30 in a different colour.

When the first 30 and second 20 plastics shells have been moulded and ejected from the moulding machine or machines, they need to sit for a period of time prior to being welded together. During or after this period, a RFID transducer 80 is placed within the pocket 82 in the first plastics shell 30 to allow tracking of the pallet; see step 96 in FIG. 7.

The first 30 and second 20 plastics shells are then welded together to seal the rims 24 and 34 to each other, and to weld the bottoms of wells 68 to the underside of the first shell 20; step 98. This is achieved using vibration welding method. The two shells 20 and 30 are brought together in a welding machine under load and with a high velocity sideward, vibrating motion. The combination produces a friction heat that melts the two rims 24 and 34, and the points of contact at the bottoms of wells 68 to join them to each other, forming a clam with sealed edges. Tops of the partitions 36 also contact the underside of the upper shell 20. The clam encloses the RFID transducer 80 and the network of partitions 36 integrally formed with the first plastics shell 30.

Once the shells 20 and 30 have been welded together, there will be a "weld bead" running around the perimeter of the sealed rims 24, 34. The "weld bead" is milled to produce a smooth joint using a high speed milling tool; see step 100 in FIG. 7.

It will be appreciated by persons skilled in the art that numerous variations and/or modifications may be made to the invention as shown in the specific embodiments without departing from the scope of the invention' as broadly described. The present embodiments are, therefore, to be considered in all respects as illustrative and not restrictive. For example, other welding methods such as ultrasonic welding, laser welding, RF welding and hot plate welding may also be used.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The invention claimed is:

1. A rectangular pallet, symmetrical about its two major axes, and comprising:

a first plastics shell formed with a flat rim, nine or more ground engaging feet subtending below the level of the rim, the feet being arranged in respective parallel spaced apart beams extending from front to back, the first plastics shell having plural channels running from side to side into the beams to form the feet, and the first plastics shell also having an array of inverted wells upwardly extending towards the rim between the beams in an underside of the plastics shell; and a second essentially flat plastics shell formed with a flat rim;

wherein an internal network of partitions extends between the first and second plastics shells;

and wherein the rims of the first and second plastics shells are sealed to each other to form a clam and to enclose the network of partitions within the clam.

2. A rectangular pallet according to claim 1, wherein the internal network of partitions extends along and across the beams in a grid-like structure between the first and second plastics shells and the array of inverted wells extends up into the second plastics shell between the network of partitions.

3. A rectangular pallet according to claim 2, wherein the internal network of partitions are integral with the first plastics shell such that tops of the internal network of partitions contact bottoms of the second plastics shell when the rims are sealed to each other.

4. A rectangular pallet according to claim 2, wherein the array of inverted wells are formed in the surface of the first plastics shell.

5. A rectangular pallet according to claim 4, wherein upper part of the array of inverted wells extends up to contact the underside of the second shell.

6. A rectangular pallet according to claim 5, wherein two shells are joined at the points of contact between the upper part of the array of inverted wells and the underside of the second plastics shell.

7. A rectangular pallet according to claim 1, wherein the beams are spaced apart from each other to allow the tines of a forklift to be inserted into channels running between them from front to back.

8. A rectangular pallet according to claim 7, wherein the feet of each beam are spaced apart from each other so that racking may engage into the channels running between them from front to back.

9. A rectangular pallet according to claim 8, wherein the channels extending from front to back are deeper than the channels running from side to side.

10. A rectangular pallet according to claim 1, wherein plural shallow recesses are formed in the upper surface of the second shell to receive the feet of another pallet that is stacked on it.

11. A rectangular pallet according to claim 1, wherein a radio frequency identification (RFID) transducer is sealed within the pallet.

12. A rectangular pallet according to claim 11, wherein the first plastics shell comprises an integral pocket shaped and sized to receive and retain the RFID transducer.

13. A rectangular pallet according to claim 1, wherein a sign is moulded into the first or second plastics shell, or both.

14. A rectangular pallet according claim 1, wherein the first plastics shell is formed with twelve ground engaging feet, the feet being arranged to form three beams of four feet each.

15. A rectangular pallet according to claim 1, wherein the shells of the clam are made of plastics material that is washable and food grade compatible.

16. A rectangular pallet according to claim 1, wherein the plastics material is impregnated with sterilizer to provide resistance against bacteria.

17. A rectangular pallet according to claim 1, wherein the plastics material is high density polyethylene (HDPE).

18. A rectangular pallet according to claim 1, wherein the first and second plastics shells are moulded in different colours.

19. A method of forming a pallet according to claim 1, comprising the steps of:

(a) moulding the first and second plastics shells;

(b) sealing the rim of the first plastics shell to the rim of the second plastics shell to form a clam.

20. A method according to claim 19, comprising the further step of placing a radio transducer within a pocket in the first plastics shell between step (a) and step (b).

21. A method according to claim 19, wherein the step of sealing also involves welding other points of contact between the two shells.

22. A method according to claim 21, wherein the step of sealing or welding or both, involves using vibration welding.

23. A method according to claim 19, comprising the further step of milling the rims.

* * * * *